US011519573B1

(12) United States Patent
Ma et al.

(10) Patent No.: US 11,519,573 B1
(45) Date of Patent: Dec. 6, 2022

(54) FIXING MEMBER FOR OPTICAL ELEMENT AND LED LAMP WITH FIXING MEMBER THEREOF

(71) Applicant: SHENZHEN SNC OPTO ELECTRONIC CO., LTD, Shenzhen (CN)

(72) Inventors: Zhiping Ma, Shenzhen (CN); Jianyong Xu, Shenzhen (CN); Anle Zhao, Shenzhen (CN)

(73) Assignee: SHENZHEN SNC OPTO ELECTRONIC CO., LTD, Shenzhen (CN)

( * ) Notice: Subject to any disclaimer, the term of this patent is extended or adjusted under 35 U.S.C. 154(b) by 0 days.

(21) Appl. No.: 17/721,365

(22) Filed: Apr. 15, 2022

(30) Foreign Application Priority Data

Jan. 10, 2022 (CN) ..... 202210023797.1

(51) Int. Cl.

| | |
|---|---|
| ***F21S 8/08*** | (2006.01) |
| ***F21V 31/00*** | (2006.01) |
| ***F21V 19/00*** | (2006.01) |
| ***F21V 17/18*** | (2006.01) |
| ***F21V 17/10*** | (2006.01) |
| ***F21V 5/00*** | (2018.01) |
| ***F21S 8/04*** | (2006.01) |
| ***F21W 131/103*** | (2006.01) |
| ***F21Y 115/10*** | (2016.01) |

(52) U.S. Cl.
CPC ..... *F21S 8/085* (2013.01); *F21V 5/007* (2013.01); *F21V 17/107* (2013.01); *F21V 17/18* (2013.01); *F21V 19/004* (2013.01); *F21V 31/005* (2013.01); *F21S 8/043* (2013.01); *F21W 2131/103* (2013.01); *F21Y 2115/10* (2016.08)

(58) Field of Classification Search
CPC ..... F21S 8/043; F21S 8/085; F21V 17/107; F21V 17/18; F21V 19/004; F21V 31/00; F21V 31/005; F21V 5/007; F21W 2131/10; F21W 2131/103
See application file for complete search history.

(56) References Cited

U.S. PATENT DOCUMENTS

2017/0146217 A1* 5/2017 McCracken, Jr. ..... F21V 5/007

FOREIGN PATENT DOCUMENTS

| | | | | |
|---|---|---|---|---|
| CN | 109084236 A | * | 12/2018 | ..... F21S 8/086 |
| CN | 211551510 U | * | 9/2020 | ..... F21V 17/107 |
| KR | 101278038 B1 | * | 6/2013 | ..... F21V 17/107 |

* cited by examiner

*Primary Examiner* — Alan B Cariaso

(57) ABSTRACT

The present disclosure provides a fixing member for an optical element and an LED lamp with the fixing member thereof. The LED lamp includes a base, an LED plate and the optical element. The LED plate includes a plurality of LED beads, the base including a receiving room that includes a mounting surface formed on the bottom thereof, the LED plate arranged on the mounting surface, and the optical element arranged on a light-emitting side of the LED plate; the LED lamp further includes a pressing member with one end being hinged to the base and the other end being buckled with the base, the pressing member presses against the optical element to keep the optical element on the base, which has advantages that the optical element can be assembled, disassembled and maintained without using tools.

15 Claims, 8 Drawing Sheets

FIXING MEMBER FOR OPTICAL ELEMENT AND LED LAMP WITH FIXING MEMBER THEREOF

BACKGROUND

1. Technical Field

The present disclosure generally relates to the field of lighting technologies, and especially relates to a fixing member for an optical element and an LED lamp with the fixing member thereof.

2. Description of Related Art

An LED street lamp is a kind of LED lamps and also called an LED shoebox lamp in the industry, which is usually used for outdoor lighting and generally includes a heat dissipation base, an LED lamp plate and an optical element installed on the base, respectively. In a conventional structure, the optical element is fixed to the base by screws, because a width and a length of the optical element are large, a plurality of screws is needed for fixing the optical element, resulting in low production efficiency. Moreover, after the LED street lamp is installed on a lamp pole or a wall, the optical element is located at the bottom of the base, in this way, when the optical element needs to be disassembled for cleaning or replacing the optical element, the screws are easy to fall to the ground during disassembling the screws from bottom to top, which is very inconvenient for operation.

SUMMARY

The technical problems to be solved: in view of the shortcomings of the related art, the present disclosure relates to a fixing member for an optical element and an LED lamp with the fixing member thereof which can solve the above technical problems as shown in the related art.

an LED lamp according to a first aspect of an embodiment of the present disclosure includes: a base, an LED plate and an optical element, the LED plate including a plurality of LED beads, the base including a receiving room that includes a mounting surface formed the bottom thereof, the LED plate arranged on the mounting surface and the optical element arranged on a light-emitting side of the LED plate. The LED lamp further includes a pressing member with one end being hinged to the base and the other end being buckled with the base, pressed against the optical element to keep the optical element on the base.

Wherein the optical element is a lens plate comprising a plurality of lens groups that is composed by a plurality of lenses integrally arranged thereon, a groove arranged between two adjacent lens groups.

Wherein the pressing member comprises an outer blank holder, a hollow portion and an internal depression bar integrally arranged thereon, the outer blank holder pressed against the optical element, the hollow portion configured to perform light transmission, and the internal depression bar comprising a reinforcing rib aligned and matched with the groove.

A fixing member configured to fix an optical element of an LED lamp on a base of the LED lamp according to a second aspect of an embodiment of the present disclosure includes: a pressing member arranged on a side of the optical element away from the base and configured to press the optical element on the base, a width and a length of the pressing member greater than that of the optical element, and one end of the pressing member hinged to the base; and at least one first fastener located on a side of the pressing member that is adjacent or opposite to a rotation end of the pressing member, and configured to buckle the other end of the pressing member on the base.

The present disclosure provides the advantages as below: the present disclosure provides the fixing member for the optical element and the LED lamp with the fixing member thereof that the optical element can be assembled, disassembled and maintained without tools. Furthermore, the internal depression bar with the reinforcing rib is provided for not only increasing structural strength of the pressing member, but also having a good waterproof effect after the reinforcing rib is matched with the groove of the optical element.

BRIEF DESCRIPTION OF THE DRAWINGS

In order to more clearly understand the technical solution hereinafter in embodiments of the present disclosure, a brief description to the drawings used in detailed description of embodiments hereinafter is provided thereof. Obviously, the drawings described below are some embodiments of the present disclosure, for one of ordinary skill in the related art, other drawings can be obtained according to the drawings below on the premise of no creative work.

Figure 1:
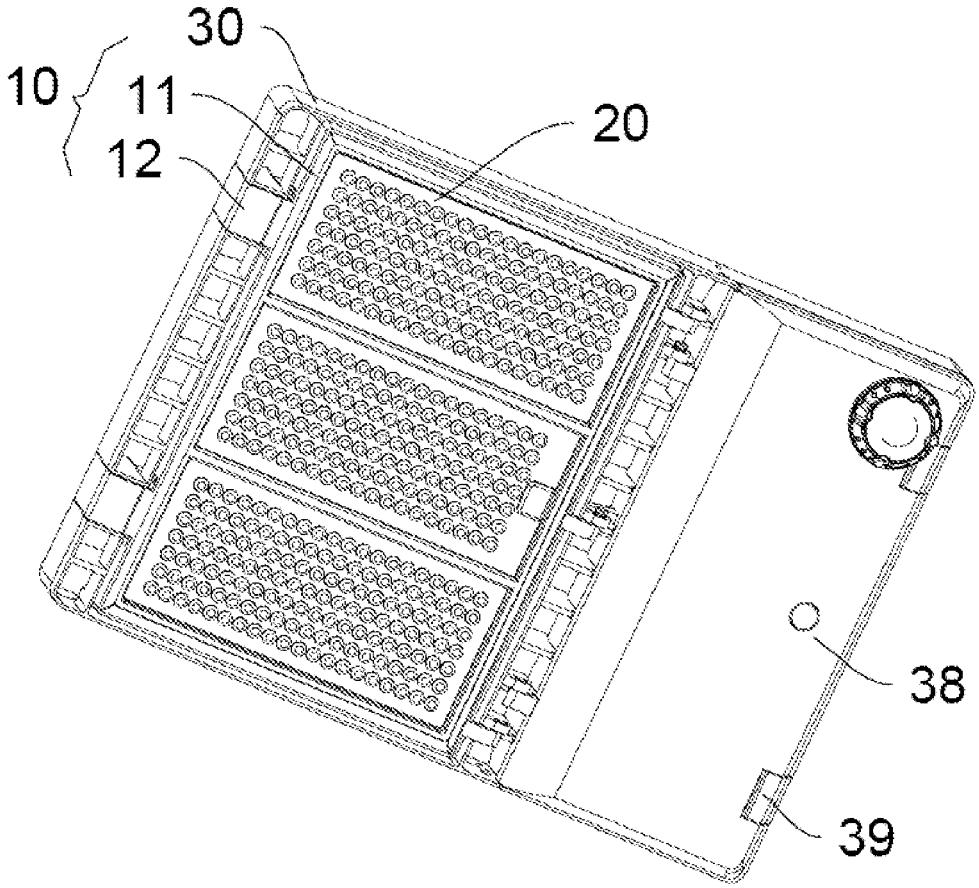
FIG. 1 is a schematic view of an LED lamp in accordance with an embodiment of the present disclosure.

The element labels according to the embodiment of the present disclosure shown as below:

fixing member 10, pressing member 11, rotation end 11*a*, adjacent side 11*b*, opposite side 11*c*, outer blank holder 111, second sealing groove 1111, hollow portion 112, internal depression bar 113, reinforcing rib 1131, rotating portion 114, first rotating shaft 1141, connecting portion 1142, locking portion 115, clamping slot 116, surrounding edge 117, first fastener 12, fastening member 121, fastening plate 1211, connecting plate 1212, mounting plate 1213, protrusion 1214, hand portion 1215, first wall 12151, second wall 12152, third wall 12153, perforated portion 1216, through-slot 1217, elastic member 122, second rotating shaft 1221, elastic arm 1222, concave surface 1222*a*, first portion 1223, second portion 1224, optical element 20, lens plate 20*a*, back edge 20*b*, front surface 20*c*, lens 21, lens group 22, protruding edge 23, second side 24, groove 25, base 30, receiving room 31, mounting surface 31*a*, bottom 31*b*, first side 311, separation groove 312, shaft hole 32, opening slot 33, concave portion 34, supporting portion 35, pressing plate 36, mounting chamber 37, opening portion 37*a*, cover plate 38, second fastener 39, LED plate 40, LED bead 41, first waterproof sealing ring 50, second waterproof sealing ring 60, power supply 70, third waterproof sealing ring 80, optical control member 90, sensor 91.

DETAILED DESCRIPTION

Reference will now be made in detail to embodiments, examples of which are illustrated in the accompanying drawings. In the following detailed description, numerous specific details are set forth in order to provide a thorough understanding of the subject matter presented herein. Obviously, the implementation embodiment in the description is a part of the present disclosure implementation examples, rather than the implementation of all embodiments, examples. According to the described exemplary embodiment of the present disclosure, all other embodiments obtained by one of ordinary skill in the related art on the premise of no creative work are within the protection scope of the present disclosure.

It should also be understood that the terms used in the specification of the present disclosure are only for the purpose of describing specific embodiments without being intended to limit the present disclosure. As used in the description of the present disclosure and the appended claims, terms of "one", "one" and "the" in a singular form are intended to include a plural form unless the context clearly indicates otherwise.

It should also be further understood that the term "and/or" used in the description of the present disclosure and the appended claims refers to any combination of one or more of associated listed items and all possible combinations, and includes these combinations.

Referring to FIGS. 1-7, an LED lamp in accordance with an embodiment of the present disclosure includes a base 30, an LED plate 40, an optical element 20, and a fixing member 10 configured to fix the optical element 20. The optical element 20 is a lens plate 20*a*, the LED plate 40 including a plurality of LED beads 41, the base 30 including a receiving room 31 that includes a mounting surface 31*a* formed the bottom thereof, the LED plate 40 arranged on the mounting surface 31*a* and the lens plate 20*a* arranged on a light-emitting side of the LED plate 40. The fixing member 10 is configured to fix the lens plate 20*a* on the base 30, and includes a pressing member 11 and at least one first fastener 12, one end of the pressing member is hinged to the base 30 and the pressing member 11 presses against the lens plate 20*a* to keep the lens plate 20*a* on the base 30, and then the pressing member 11 is buckled on the base 30 through the first fastener 12 to ensure firmness of the lens plate 20*a*. The present disclosure can assemble, disassemble and maintain the optical element 20 without tools, which is convenient for operation and reduces labor costs.

Figure 2:
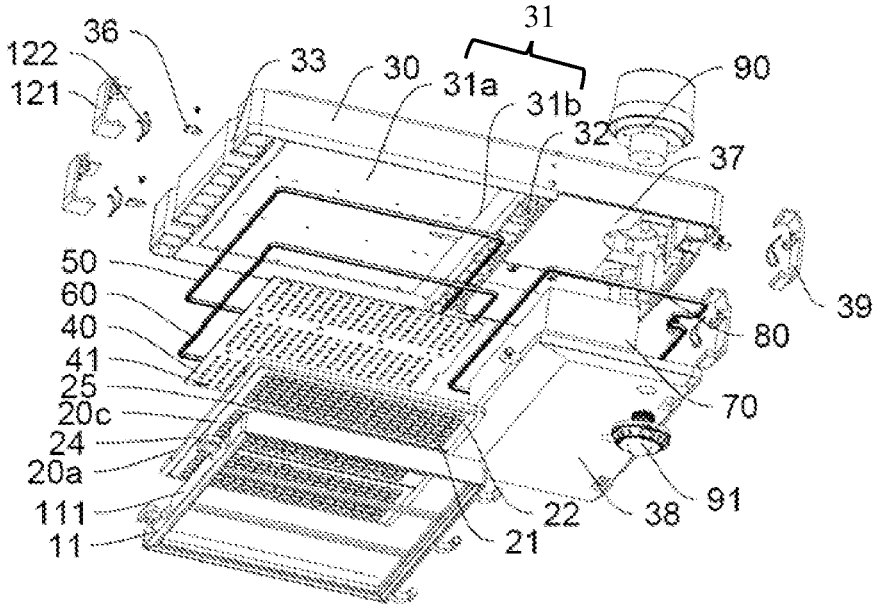
FIG. 2 is an exploded, schematic view of the LED lamp of FIG. 1.
Figure 3:
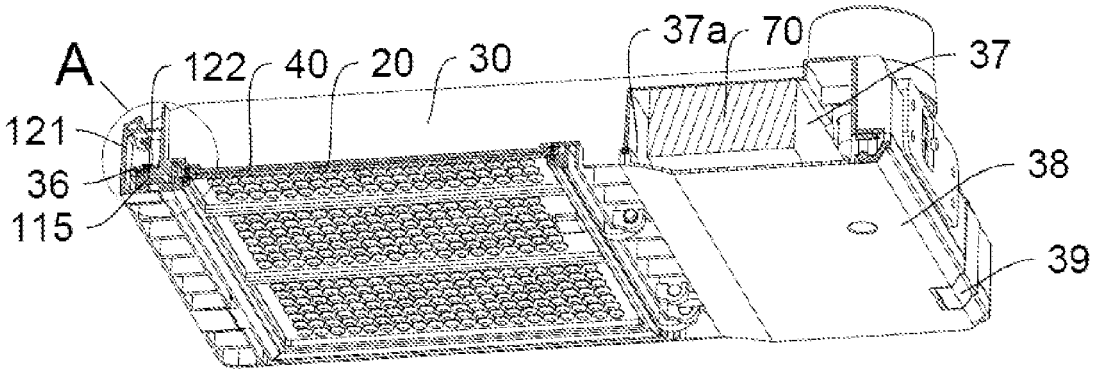
FIG. 3 is a cross sectional view of the LED lamp of FIG. 1.
Figure 8:
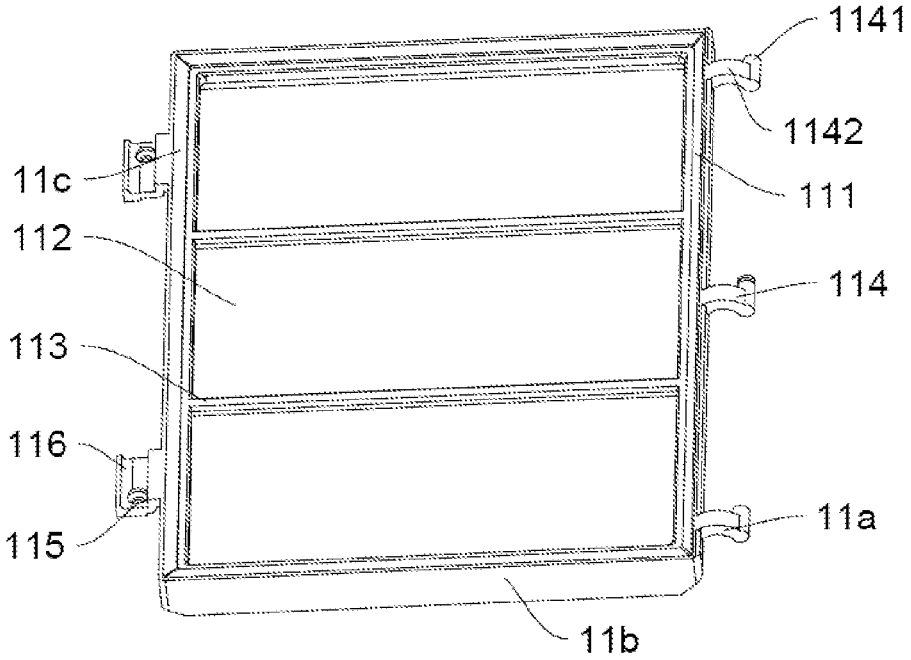
FIG. 8 is a schematic view of a pressing member of the LED lamp of FIG. 1.
Figure 11:
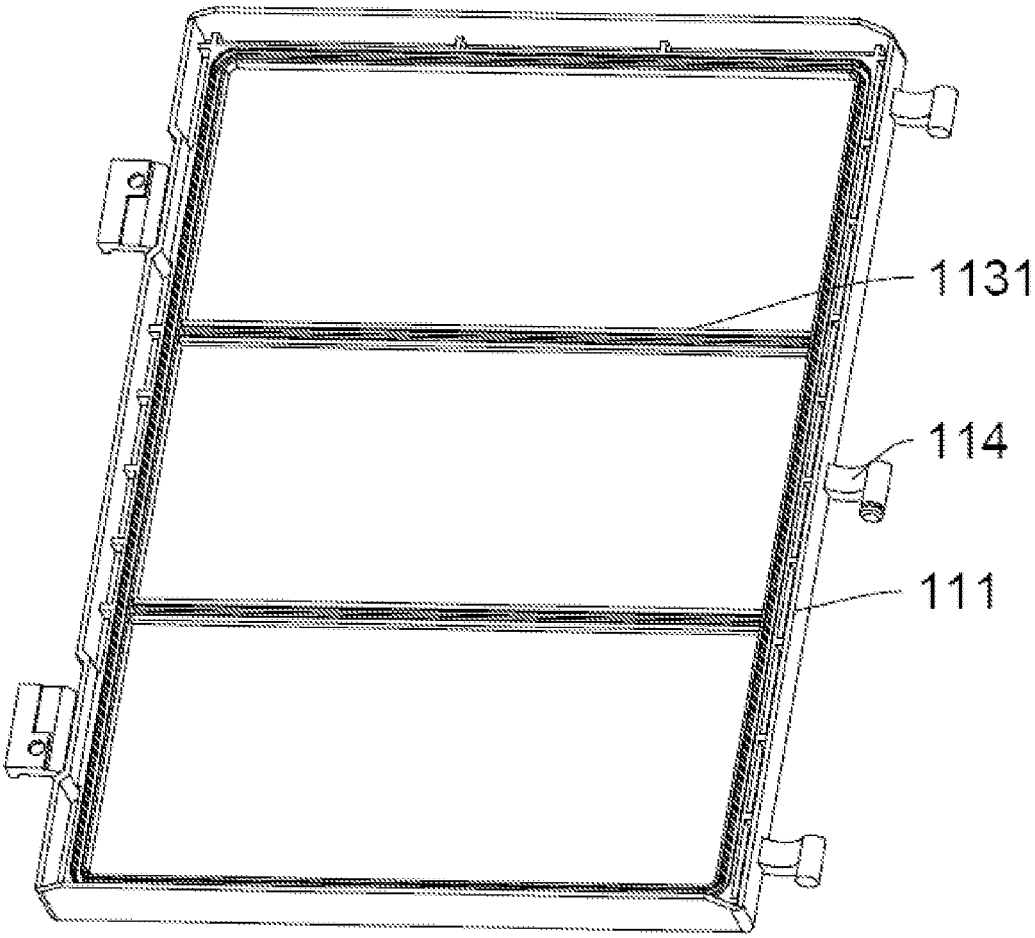
FIG. 11 is similar to FIG. 8, but shown the pressing member from another view.

Referring to FIG. 8, the pressing member 11 includes an outer blank holder 111 with a frame-shaped configuration, and at least one hollow portion 112, a width and a length of the outer blank holder 111 greater than that of the lens plate 20*a* to press against the periphery of the whole lens plate 20*a*, and the hollow portion 112 is configured to perform light transmission. It can be understood that when there is a plurality of hollow portions 112, an internal depression bar 113 is arranged between each two adjacent hollow portions 112 so that each two adjacent hollow portions 112 can be separated by the internal depression bar 113. The internal depression bar 113 does not affect light emitted from the LED beads 41, and also presses against a middle of the lens plate 20*a*, in this way, a pressure applied on the lens plate 20*a* by the pressing member 11 is more uniform through the outer blank holder 111 and the internal depression bar 113. Referring to FIG. 11 and FIG. 2, the internal depression bar 113 includes a reinforcing rib 1131, and the optical element 20 includes a groove 25 aligned with the convex reinforcing rib 1131. Furthermore, the internal depression bar 113 with the reinforcing rib 1131 can not only increase structural strength of the pressing member 11, but also have a good waterproof effect after the reinforcing rib 1131 is matched with the groove 25 of the optical element 20.

In combination with referring to FIG. 1 to FIG. 7, the lens plate 20*a* includes a plurality of lens groups 22 that is composed by a plurality of lenses 21 integrally arranged thereon. The plurality of lenses 21 is aligned with the plurality of LED beads 41, so as to distribute the light emitted from the plurality of LED beads 41. In an embodiment of the present disclosure, three groups of lens groups 22 are arranged on the lens plate 20*a*, and two internal depression bars 113 are included in the pressing member 11 to form three hollow portions 112 therein, in this way, the three hollow portions 112 match with the three groups of lens groups 22, respectively. Two ends of the internal depression bar 113 are respectively connected to two outer blank holders 111 that are formed front and rear thereof, and the internal depression bar 113 presses against a portion between two adjacent groups of lens groups 22. When the LED lamp is used outdoors, a second waterproof sealing ring 60 needs to be set between the pressing member 11 and the lens plate 20*a*, and a first waterproof sealing ring 50 needs to be set between the lens plate 20*a* and the base 30, in this way, a force applied on the lens plate 20*a* by the pressing member 11 can be more uniform by providing the internal depression bar 113, so that the first waterproof sealing ring 50 and the second waterproof sealing ring 60 are evenly stressed without being easy to deform, so as to obtain a better waterproof effect therebetween.

The pressing member 11 further includes a surrounding edge 117 located at the periphery of the outer blank holder 111, a height of the surrounding edge 117 greater than that of the outer blank holder 111; the bottom 31*b* of the receiving room 31 is concave towards a backlight side of the LED plate 40 to form a separation groove 312, the separation groove 312 located at the periphery of the LED plate 40, a depth of the separation groove 312 greater than that of the receiving room 31, and the surrounding edge 117 inserted into the separation groove 312. Since the bottom 31*b* of the receiving room 31 is provided with the separation groove 312, and the surrounding edge 117 of the pressing member 11 is inserted into the separation groove 312, in this way, rainwater flowing from the base 30 can only continue to flow downwardly along an outer surface of the surrounding edge 117 and drip to the ground, rather than flowing to the LED lamp plate 40, which can obtain the better waterproof effect of the LED lamp.

The outer blank holder 111 is pressed against the outer periphery of the lens plate 20*a*, the second waterproof sealing ring 60 arranged between the outer blank holder 111 and the lens plate 20*a*, the first waterproof sealing ring 50 arranged between the lens plate 20*a* and the base 30. The outer periphery of the lens plate 20*a* is surrounded by the surrounding edge 117 of the pressing member 11, and the lens plate 20*a* can be surrounded and positioned by the pressing member 11 through the surrounding edge 117, so that the lens plate 20*a* is not easy to be offset, which is convenient for rapidly assembling the lens plate 20*a*. In addition, since the back of the base 30 will accumulate dust and bird droppings after being used for a certain period of time, once it rains, these dust and bird droppings will be mixed with the rain to form sewage. The surrounding edge 117 is provided to prevent the sewage from flowing onto the lens plate 20*a* from the back of the base 30 to contaminate the lens plate 20*a*, so as to ensure a light output efficiency of the lens plate 20*a*.

A portion between the mounting surface 31*a* and the separation groove 312 is concaved towards a backlight surface of the base 30 to form a stepped first side 311, a back edge 20*b* of the lens plate 20*a* includes a protruding edge 23 correspondingly aligned with the first edge 311. During assembly, the lens plate 20*a* can be quickly aligned with the first edge 311 through the protruding edge 23, so as to improve production efficiency thereof. Of course, the first edge 311 can also adopt a convex shape, and the back 20*b* of the lens plate 20*a* correspondingly adopts a concave shape.

The periphery of a front surface 20*c* of the lens plate 20*a* is concaved towards the backlight surface of the base 30 to form a stepped second edge 24, and the second edge 24 is aligned with the outer blank holder 111 up and down. After a lamp cap of the LED lamp is installed and fixed on a lamp pole or a wall, when the lens plate 20*a* needs to be replaced or disassembled, the lens plate 20*a* can be aligned with the pressing member 11 through the second edge 24 and placed on the pressing member 11 in advance, and then the pressing member 11 drives the lens plate 20*a* to rotate upwardly and presses against the lens plate 20*a*. Of course, the second edge 24 can also adopt a convex shape, and a surface of the outer blank holder 111 corresponding to the second edge 24 adopts a concave shape.

The pressing member 11 further includes at least one rotating portion 114, the at least one rotating portion 114 including a first rotating shaft 1141 rotationally connected with the base 30, and a connecting portion 1142 connected with the outer blank holder 111 and the first rotating shaft 1141. In an optional embodiment of the present disclosure, there are three rotating portions 114 arranged at intervals. The base 30 includes a plurality of shaft holes 32 arranged on one side of the receiving room 31, the number of shaft holes 32 is the same as that of the rotating portions 114, the first rotating shaft 1141 inserted into the shaft hole 32. The base 30 also includes at least one opening slot 33 arranged on the other side of the receiving room 31 and configured to receive the first fastener 12 therein.

The pressing member 11 further includes a locking portion 115 connected to the outer blank holder 111 and corresponding to the first fastener 12. The locking portion 115 is fastened by the first fastener 12 to press the pressing member 11 on the lens plate 20*a*, so as to fix the lens plate 20*a* with the base 30.

Figure 9:
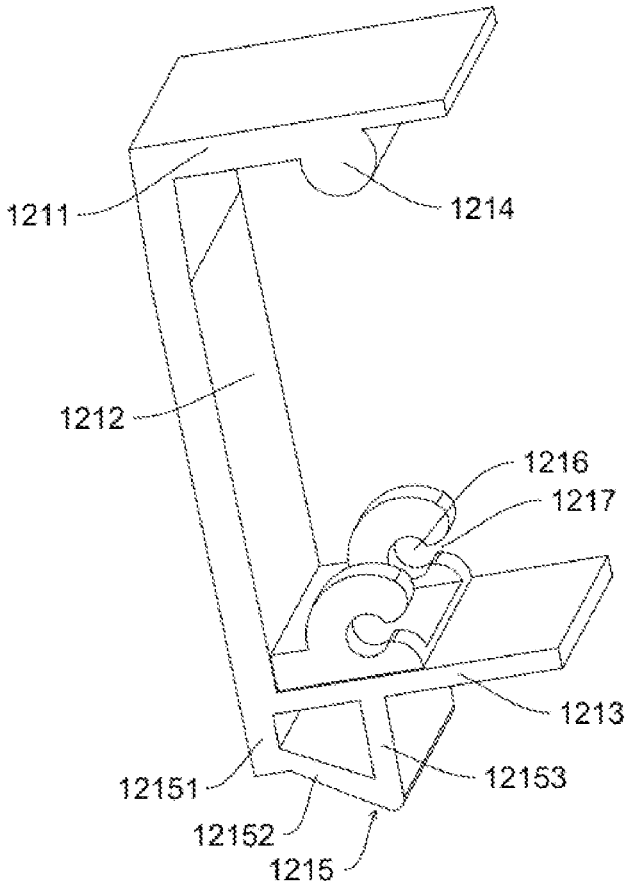
FIG. 9 is a schematic view of a fastening member of the LED lamp of FIG. 1.
Figure 10:
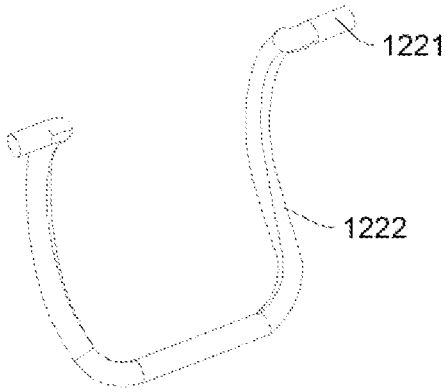
FIG. 10 is a schematic view of an elastic member of the LED lamp of FIG. 1.

In combination with referring to FIG. 9 and FIG. 10, the first fastener 12 includes a fastening member 121 and an elastic member 122. The fastening member 121 includes a fastening plate 1211, a connecting plate 1212 and a mounting plate 1213. The fastening plate 1211 is arranged opposite to the mounting plate 1213. One end of the connecting plate 1212 is connected to the fastening plate 1211, and the other end of the connecting plate 1212 is connected to the mounting plate 1213. The elastic member 122 includes a second rotating shaft 1221 and an elastic arm 1222 (as shown in FIG. 10). The second rotating shaft 1221 is close to a first portion 1223 of the elastic member 122, and the elastic arm 1222 is arranged close to a second portion 1224 of the elastic member 122 that is opposite to the first portion 1223. The fastening plate 1211 includes a protrusion 1214, the locking portion 115 including a clamping slot 116 arranged corresponding to the protrusion 1214, a size and a shape of the clamping slot 116 matched with the protrusion 1214, so that the protrusion 1214 can be clamped into the clamping slot 116. The second rotating shaft 1221 is rotationally arranged on the mounting plate 1213, the elastic arm 1222 extending to the fastening plate 1211, and the base 30 including a concave portion 34 corresponding to the elastic arm 1222, for clamping the elastic arm 1222 into the concave portion 34. The opening slot 33 includes a supporting portion 35 corresponding to the locking portion 115, so that the locking portion 115 is buckled on the supporting portion 35 through the protrusion 1214. The concave portion 34 is arranged on a side of the supporting portion 35 away from the locking portion 115. The second rotating shaft 1221 of the elastic member 122 is inserted into the mounting plate 1213, and the elastic arm 1222 of the elastic member 122 is clamped into the concave portion 34.

Figure 4:
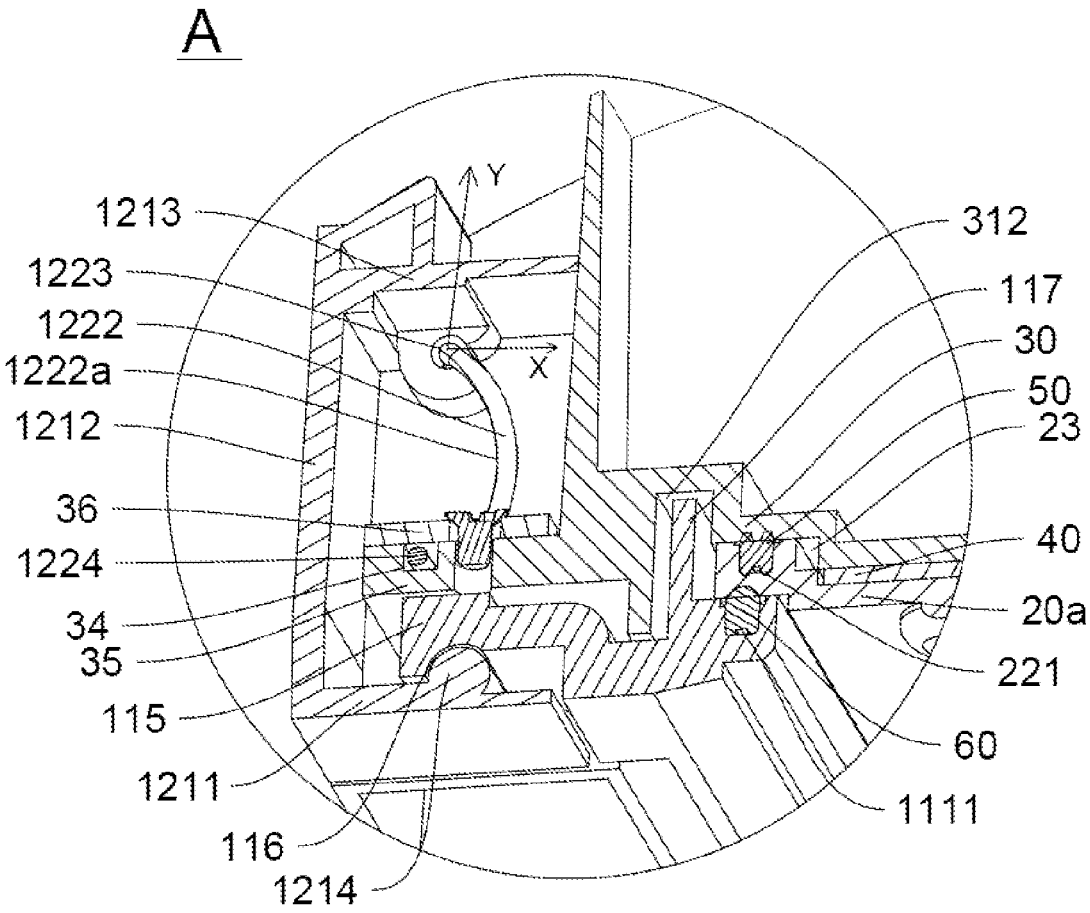
FIG. 4 is a partial enlarged view of circle A of FIG. 3.
Figure 5:
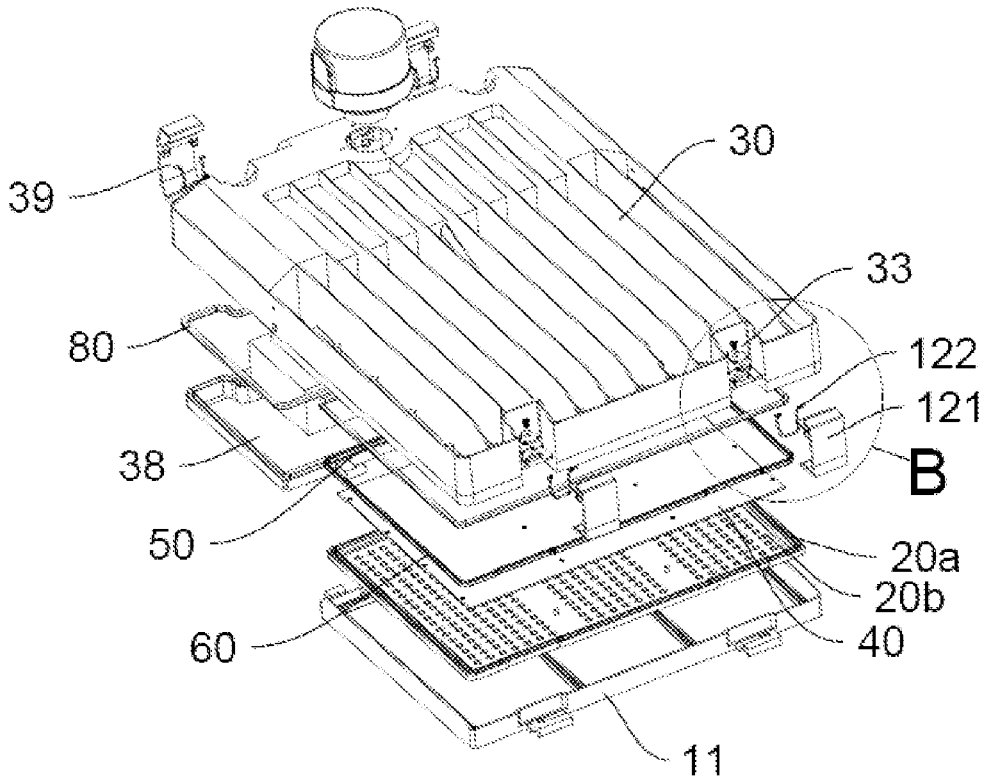
FIG. 5 is similar to FIG. 3, but shown from another view.
Figure 6:
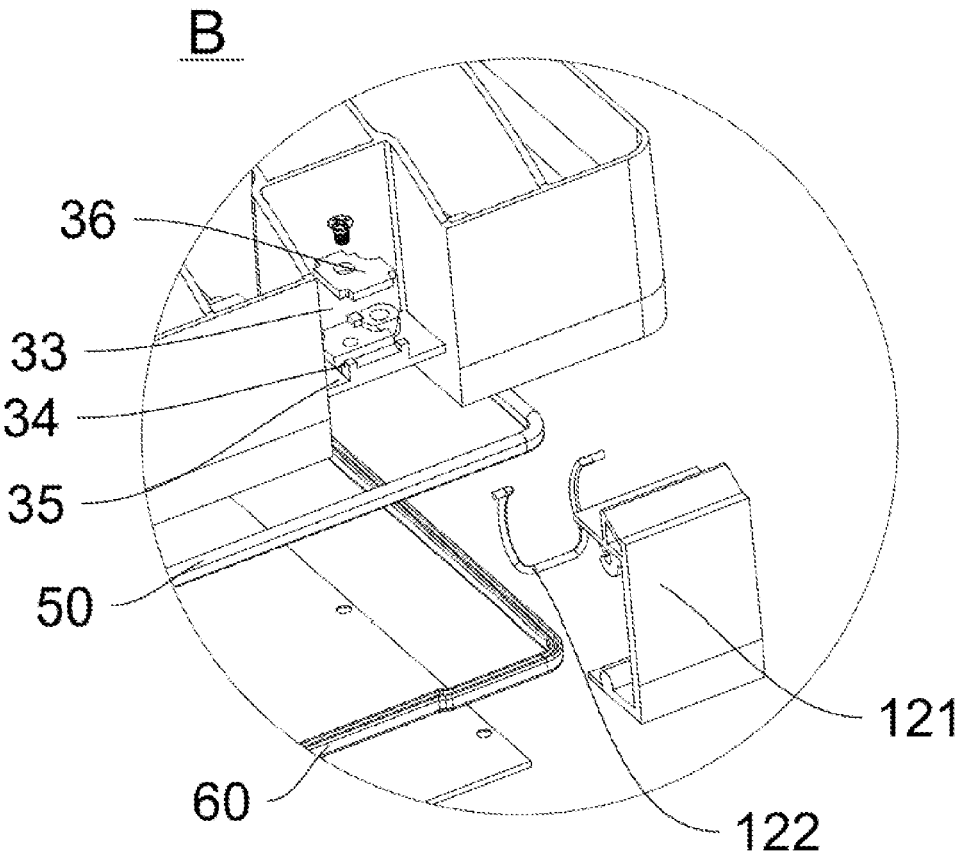
FIG. 6 is a partial enlarged view of circle B of FIG. 5.
Figure 7:
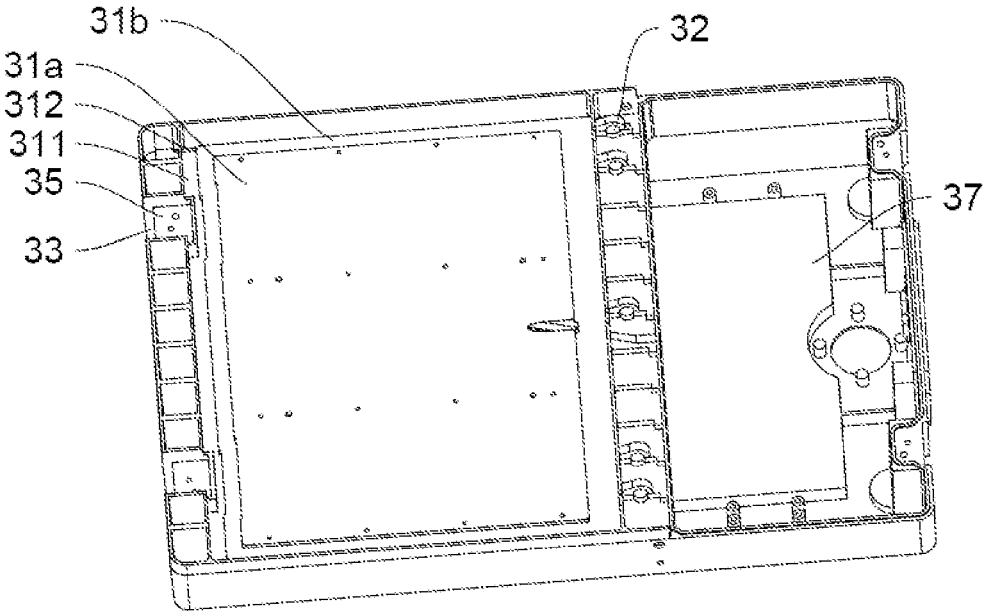
FIG. 7 is a schematic view of a base of the LED lamp of FIG. 1.

Referring to FIG. 4, in an embodiment of the present disclosure, the elastic arm 1222 is an arc configuration, and an arc concave surface 1222*a* of the elastic arm 1222 faces the connecting plate 1212, that is, the elastic arm 1222 protrudes outwardly along a direction away from the connecting plate 1212. In this way, the elastic arm 1222 provides component forces along two directions of an X direction and a Y direction for the mounting plate 1213. The force along the X direction makes an end of the mounting plate 1213 abut against the side of the base 30, and the force along the Y direction makes the fastening plate 1211 press against the locking portion 115 of the pressing member 11. When the fastening member 121 is opened, an outer side of the mounting plate 1213 is pressed that the first portion 1223 moves to the second portion 1224 (i.e. a side of the locking portion 115), so that the fastening plate 1211 of the fastening member 121 is separated from the locking portion 115, and then the fastening member 121 rotates until the fastening member 121 fully separates from the locking portion 115, to take out the lens plate 20*a* for maintenance.

Referring to FIG. 9, the mounting plate 1213 includes a perforated portion 1216, and a through-slot 1217 is arranged on the perforated portion 1216, the second rotating shaft 1221 penetrating into the perforated portion 1216. The through-slot 1217 is arranged to conveniently replace the fastening member 121. When the fastening member 121 is damaged, the second rotating shaft 1221 of the elastic member 122 can be conveniently taken out of the through-slot 1217 to replace the fastening member 121.

Referring to FIG. 4, in some embodiments of the present disclosure, in order to increase stability of the elastic member 122, a pressing plate 36 is arranged on the side of the supporting portion 35 facing the mounting plate 1213. After clamping the elastic arm 1222 into the concave portion 34, the pressing plate 36 is fixed by screws to prevent dislocation of the elastic arm 1222 during assembly and disassembly the LED lamp.

Referring to FIG. 9, in some embodiments of the present disclosure, the fastening member 121 is a U-shaped configuration and further includes a hand portion 1215 including a first wall 12151, a second wall 12152 and a third wall 12153 connected in sequence, the first wall 12151 connected to one end of the connecting plate 1212 close to the mounting plate 1213, the third wall 12153 connected to the mounting plate 1213, and an obtuse angle formed between the second wall 12152 and the connecting plate 1212. When the LED lamp is maintained by the user, the fastening member 121 can be easily disassembled by holding the fastening plate 1211, the connecting plate 1212 and the second wall 12152. The hand portion 1215 is provided to conveniently maintain and use the fastening member 121.

Referring to FIG. 2, the LED lamp further includes a mounting chamber 37, a cover plate 38, a power supply 70 and/or a controller. The power supply 70 is received in the mounting chamber 37, and the cover plate 38 is hinged to an opening portion 37*a* of the mounting chamber 37, so as to seal the opening portion 37*a* of the mounting chamber 37. One end of the cover plate 38 is hinged to the base 30, and the other end of the cover plate 38 is fastened to the base 30 through a plurality of second fasteners 39. In this way, by fixing the cover plate 38, the cover plate 38 can be opened manually, so as to perform maintenance processing on the power supply 70 and/or the controller. An optical control member 90 and/or a sensor 91 are/is also received in the mounting chamber 37. Through the optical control member 90, the LED lamp can be controlled to automatically turn on or off the power supply 70 according to an ambient brightness, so as to implement the purpose of automation and energy saving. The sensor 91 can be an infrared sensor that can sense the human body, so as to determine whether people exist, so as to automatically control the LED lamp to turn on or off. A third waterproof sealing ring 80 is also arranged between the cover plate 38 and the mounting chamber 37 to prevent water from entering the power supply 70. A structure of the second fastener 39 is similar to that of the first fastener 12, which will not be repeated here.

Referring to FIGS. 1-4, a fixing member 10 configured to fix an optical element 20 of an LED lamp on a base 30 of the LED lamp according to an embodiment of the present disclosure includes: a pressing member 11 and at least one first fastener 12 configured to press the optical element 20 against the base 30. A width and a length of the pressing member 11 are greater than that of the optical element 20, and one end of the pressing member 11 is hinged to the base 30. The at least one first fastener 12 is located on an adjacent side 11*b* of the pressing member 11 that is adjacent to a rotation end 11*a* of the pressing member 11, or located on an opposite side 11*c* of the pressing member 11 that is opposite to the rotation end 11*a* of the pressing member 11, so as to fix the optical element 20 with the base 30.

When using the fixing member 10 of the present disclosure, the one end of the pressing member 11 is hinged to the base 30, and the pressing member 11 rotates to press against the optical element 20, and then the pressing member 11 is buckled through the first fastener 12, so as to fix the optical element 20 on the base 30. The present disclosure can fix the optical element 20 on the LED lamp without by a screw fixation way, which has high assembly efficiency, convenient disassembly and labor cost saving. The present disclosure is applicable to a situation that both the lamp plate and the optical element are large, which does not need to be fixed by screws and is convenient for assembly the LED lamp.

The first fastener 12 includes a fastening member 121 and an elastic member 122, the elastic member 122 including a first portion 1223 rotationally connected to the fastening member 121, and a second portion 1224 rotationally connected to the base 30. The fastening member 121 is rotationally arranged through the elastic member 122 to snap or open the pressing member 11. When the fastening member 121 engages with the pressing member 11, the elastic member 122 provides support for the fastening member 121 to engage with the pressing member 11; when the first portion 1223 of the elastic member 122 moves to the second portion 1224, the fastening member 121 is separated from the pressing member 11. At this time, the pressing member 11 can be opened by rotating, so that the optical element 20 can be taken out for maintenance.

Although the features and elements of the present disclosure are described as embodiments in particular combinations, each feature or element can be used alone or in other various combinations within the principles of the present disclosure to the full extent indicated by the broad general meaning of the terms in which the appended claims are expressed. Any variation or replacement made by one of ordinary skill in the related art without departing from the spirit of the present disclosure shall fall within the protection scope of the present disclosure.

What is claimed is:

1. An LED lamp comprising a base, an LED plate and an optical element, the LED plate comprising a plurality of LED beads, the base comprising a receiving room that comprises a mounting surface formed a bottom thereof, the LED plate arranged on the mounting surface, and the optical element arranged on a light-emitting side of the LED plate, and wherein the LED lamp further comprises a pressing member hinged to the base and pressed against the optical element to keep the optical element on the base; and wherein the optical element is a lens plate comprising a plurality of lens groups that is composed by a plurality of lenses integrally arranged thereon, a groove arranged between two adjacent lens groups; and wherein the pressing member comprises an outer blank holder and a surrounding edge located at a periphery of the outer blank holder, a height of the surrounding edge greater than that of the outer blank holder; the bottom of the receiving room is concave towards a backlight side of the LED plate to form a separation groove, the separation groove located at a periphery of the LED plate, a depth of the separation groove greater than that of the receiving room, and the surrounding edge inserted into the separation groove.

2. The LED lamp as claimed in claim 1, wherein the pressing member comprises a hollow portion and an internal depression bar integrally arranged thereon, the outer blank holder pressed against the optical element, the hollow portion configured to perform light transmission, and the internal depression bar comprising a reinforcing rib aligned and matched with the groove.

3. The LED lamp as claimed in claim 1, wherein the outer blank holder presses against an outer periphery of the lens plate, a first waterproof sealing ring arranged between the lens plate and the base, a second waterproof sealing ring arranged between the outer blank holder and the lens plate, and the outer periphery of the lens plate surrounded by a periphery of the pressing member.

4. The LED lamp as claimed in claim 1, wherein a first side is concave or convex at a portion between the separation groove and the mounting surface, and a back edge of the lens plate is aligned with the first side.

5. The LED lamp as claimed in claim 4, wherein a second side is concave or convex at a periphery of a front surface of the lens plate, and the second side is aligned with the outer blank holder of the pressing member.

6. The LED lamp as claimed in claim 1, wherein one end of the pressing member is rotationally connected with the base, and the other end of the pressing member is clamped with the base through a first fastener; the first fastener arranged on the base or the pressing member.

7. The LED lamp as claimed in claim 6, wherein the first fastener is arranged on the base and comprises an elastic member and a fastening member, one end of the elastic member rotationally connected with the base, and the other end of the elastic member rotationally connected with the fastening member; the pressing member comprising a locking portion extending outwardly from the outer blank holder of the pressing member, and the fastening member buckled on the locking portion.

8. The LED lamp as claimed in claim 7, wherein the base further comprises a mounting chamber configured to receive a power supply therein, an opening portion of the receiving room hinged with a cover plate, one end of the cover plate hinged with the base, and the other end of the cover plate clamped with the base through a second fastener; and an optical control member arranged on the mounting chamber.

9. A fixing member configured to fix an optical element of an LED lamp on a base of the LED lamp; the fixing member comprising:

a pressing member arranged on a side of the optical element away from the base and configured to press the optical element on the base, a width and a length of the pressing member greater than that of the optical element, and one end of the pressing member hinged to the base; and at least one first fastener located on an adjacent side that is adjacent to a rotating end of the pressing member, or an opposite side that is opposite to the rotation end of the pressing member, and configured to buckle the other end of the pressing member on the base; and wherein the pressing member comprises:

an outer blank holder with a width and a length greater than that of the optical element, configured to press against the optical element;

at least one hollow portion arranged within the outer blank holder and configured to perform light transmission; and wherein the pressing member further comprises a locking portion integrally connected to the outer blank holder, and arranged corresponding to the first fastener that is configured to buckle or open the locking portion; and wherein the first fastener comprises a fastening member and an elastic member, a first end of the elastic member rotationally connected to the fastening member, an opposite second end of the elastic member rotationally connected to the base, and the fastening member rotationally arranged through the elastic member to buckle or open the pressing member; when the fastening member is buckled with the pressing member, the elastic member provides a supporting force for the fastening member to buckle the pressing member; and when the first end moves to the second end, the fastening member is separated from the pressing member to open the pressing member.

10. The fixing member as claimed in claim 9, wherein the pressing member further comprises at least one rotating portion, the at least one rotating portion comprising a first rotating shaft rotationally connected with the base, and a connecting portion connected with the outer blank holder and the first rotating shaft.

11. The fixing member as claimed in claim 9, wherein the fastening member comprises:

a fastening plate configured to fasten the locking portion;

a mounting plate arranged opposite to the locking portion; and a connecting plate connected with the fastening plate and the mounting plate;

and wherein the first end of the elastic member is rotationally connected to the mounting plate, the second end of the elastic member rotationally connected to a position of the base corresponding to the mounting plate, the fastening plate comprising a protrusion, and the locking portion comprising a clamping slot corresponding to the protrusion; when the fastening plate clamps with the locking portion, the protrusion is buckled into the clamping slot.

12. The fixing member as claimed in claim 11, wherein the elastic member comprises a second rotating shaft rotationally connected to the mounting plate, and an elastic arm extending to the fastening plate, the base comprising a concave portion corresponding to the elastic arm, and the elastic arm clamped into the concave portion.

13. The fixing member as claimed in claim 12, wherein the elastic arm is an arc configuration, and a concave surface of the elastic arm faces the connecting plate.

14. The fixing member as claimed in claim 12, wherein the mounting plate comprises a perforated portion, and a through-slot arranged on the perforated portion; the second rotating shaft penetrating into the through-slot, and the through-slot configured to put or take out the second rotating shaft.

15. The fixing member as claimed in claim 11, wherein the fastening member further comprises a hand portion comprising a first wall, a second wall and a third wall connected in sequence, the first wall connected to one end of the connecting plate close to the mounting plate, the third wall connected to the mounting plate, and an obtuse angle formed between the second wall and the connecting plate.

* * * * *